US005727507A

United States Patent [19]

Johansson

[11] Patent Number: 5,727,507

[45] Date of Patent: Mar. 17, 1998

[54] VALVE ROTATION ARRANGEMENT

[75] Inventor: Peter Johansson, Trollhättan, Sweden

[73] Assignee: Wartsila Diesel International Ltd OY, Helsinki, Finland

[21] Appl. No.: 727,682

[22] Filed: Oct. 8, 1996

[30] Foreign Application Priority Data

Oct. 10, 1995 [FI] Finland ..... 954825

[51] Int. Cl.[6] ..... F01L 1/32

[52] U.S. Cl. ..... 123/90.3; 123/188.11; 251/227

[58] Field of Search ..... 123/90.28, 90.3, 123/188.11, 188.12, 188.13; 251/227

[56] References Cited

U.S. PATENT DOCUMENTS

| | | | |
|---|---|---|---|
| 1,454,423 | 5/1923 | Anthony | 123/90.3 |
| 2,590,719 | 3/1952 | MacPherson . | |
| 2,705,483 | 4/1955 | Temple | 123/90.28 |
| 2,819,706 | 1/1958 | Gammon | 123/90.3 |
| 2,827,029 | 3/1958 | Norton | 123/90.3 |
| 2,838,036 | 6/1958 | Repko et al. | 123/90.28 |
| 3,421,734 | 1/1969 | Updike et al. | 123/90.3 |
| 3,890,943 | 6/1975 | Schonlau et al. | 123/90.28 |
| 4,007,716 | 2/1977 | Jones | 123/90.28 |
| 5,343,835 | 9/1994 | Rhodes | 123/90.28 |
| 5,570,663 | 11/1996 | Shida | 123/90.3 |

FOREIGN PATENT DOCUMENTS

| | | |
|---|---|---|
| 880 969 | 6/1953 | Germany . |
| 30 40 519 | 5/1982 | Germany . |
| 39 06 725 | 4/1990 | Germany . |
| 195 00 321 | 6/1995 | Germany . |
| 761405 | 11/1956 | United Kingdom . |

*Primary Examiner*—Erick R. Solis
*Attorney, Agent, or Firm*—Smith-Hill and Bedell

[57] ABSTRACT

An improved valve rotation arrangement for providing valve rotation for a pressure medium valve in an internal combustion engine, especially a large diesel engine or gas engine, whereby the valve is opened under positive guidance for instance under the influence of a rocker arm and is closed by means of a spring, comprises a bearing arrangement for turnably journalling the upper part of a valve stem to the valve spring and a rotation mechanism supported to the cylinder head of the engine and arranged to provide valve rotation. The bearing arrangement comprises a slide bearing between a rotation element, arranged to the upper part of the valve stem, and a bearing housing element supported to the valve spring.

21 Claims, 5 Drawing Sheets

VALVE ROTATION ARRANGEMENT

BACKGROUND OF THE INVENTION

This invention relates to an improved valve rotation arrangement for providing valve rotation for a pressure medium valve in an internal combustion engine, especially a large diesel engine or gas engine, whereby the valve is opened under positive guidance for instance under the influence of a rocker arm and is closed by means of a spring, comprising a bearing arrangement for turnably journalling the upper part of a valve stem to the valve spring and a rotation mechanism supported to the cylinder head of the engine and arranged to provide valve rotation.

Large engines refer here to such engines that may be employed, for example, as the main propulsion engines or the auxiliary engines for ships or for power plants for producing electricity and/or heat energy. A gas engine on the other hand refers here to a combustion engine in which the basic fuel used is a gaseous fuel, for example natural gas. A gas engine may operate either on OTTO-principle or on diesel-principle.

Valve rotators are utilized for the purpose of improving operational qualities and the lifetime of engine valves. They may be used for both outlet and inlet valves. Especially with outlet valves blow-bys at the sealing surface and burning off of the valve may occur, which can be prevented by means of valve rotation. With inlet valves wear can be decreased as well through valve rotation so as to balance the temperature gradient.

There are a relatively great number of different constructional variations depending on where and how the actual rotation is accomplished and where and in which way bearing arrangement between the valve and the cylinder head is accomplished. A problem with the present valve rotators is that due to the construction thereof, especially utilization of ball bearings between the movable parts, the lifetime is not sufficient to be in proportion with the other components in the valve mechanism of the engine. Because of vibrations and high static load during the time the valve is closed, the impulse caused when the valve is closed as well as the small rotation to be provided, the ball bearings are damaged. With increased damage in the bearings, the rotation is hampered or alternatively is totally blocked. A further problem is the fact that the possibility to enlarge the dimensions of the bearings so as to increase the strength thereof is in practice very limited.

An aim of the invention is to provide an improved valve rotation arrangement with an uncomplicated and economic construction and with which the drawbacks described above can with advantage be eliminated. The invention aims to extend the lifetime of the bearing in a valve rotator between the valve spring and the valve. The bearing should with reasonable costs and compact design endure high static and dynamic loads under vibration without being damaged under long operation time. A further aim is to provide a valve rotation arrangement to be utilized in and especially suitable for large diesel engines and gas engines as referred to above.

SUMMARY OF THE INVENTION

According to a first aspect of the present invention there is provided a valve arrangement in an internal combustion engine including a cylinder head, said valve arrangement comprising a valve member having a stem, the valve member being displaceable relative to the cylinder head between a closed position and an open position, a valve actuator for displacing the valve member from its closed position toward its open position under positive guidance, a spring for urging the valve member from its open position toward its closed position, a rotation element attached to an upper part of the valve stem, a bearing housing element supported on the spring, a slide bearing between the rotating element and the bearing housing element for turnably journalling an upper part of the valve stem to the spring, and a rotation mechanism supported at the cylinder head for providing rotation of the valve relative to the cylinder head.

According to a second aspect of the present invention there is provided a valve arrangement in an internal combustion engine including a cylinder head, said valve arrangement comprising a valve member having a stem, the valve member being displaceable relative to the cylinder head lengthwise of the stem between a closed position and an open position, a valve actuator for displacing the valve member from its closed position toward its open position under positive guidance, a spring supported at the cylinder head for urging the valve member from its open position toward its closed position, a rotation element attached to an upper part of the valve stem, a bearing housing element supported on the spring, and a slide bearing between the rotating element and the bearing housing for turnably journalling an upper part of the valve stem to the spring, and wherein the spring functions as a rotation mechanism supported at the cylinder head for providing rotation of the valve relative to the cylinder head.

In the preferred embodiment of the invention, a compact design and at the same time a low specific surface pressure is accomplished since the whole space available is utilized as a bearing surface, whereby damage can effectively be avoided in the bearing in spite of the operation thereof under vibrations. Thus the arrangement brings about little wear thereby providing long lifetime. It makes an uncomplicated design possible also for elements located nearby, i.e. for instance the rotation element and the bearing housing element. In addition, the arrangement according to the invention can easily be replaced. All this means cost effective construction. Although the arrangement according to the invention also brings about a somewhat higher coefficient of friction than for example a construction based on ball bearings, this has no significant negative effect on the operation as such.

A very uncomplicated construction can be achieved when the valve spring itself functions as the rotation mechanism. This embodiment makes use of the screw-like movement of the valve spring during especially the compression operation with the additional assistance of the vibrations of the engine.

Alternatively, the rotation mechanism may comprise a positively guided mechanism arranged to force rotation of the valve in one direction and to block it in the opposite direction. In this case, the rotation element is arranged to be in force transmitting connection with the rotation mechanism.

For minimizing the oscillating mass, the bearing housing element and/or the rotation element may with advantage be selected to be of a material serving as bearing metal, which is of advantage for the whole valve mechanism.

Alternatively, at least one separate bearing washer may be arranged between the bearing housing element and the rotation element.

According to an advantageous embodiment of the invention, the bearing housing element is bowl-formed so that it includes a circular protrusion enclosing the rotation element and preferably extending somewhat above the upper surface of the rotation element. Then the protrusion and the rotation element may additionally be so dimensioned that a circular slot remains between these members. In case force transmission from the rocker arm or other valve actuator to the valve stem is arranged through a valve yoke provided with at least one oil duct, feeding of oil to the top of the valve can be arranged through said duct so that an oil pocket is formed between the bearing housing element and the rotation element. Hereby the bearing arrangement is always well lubricated and an effective lubrication of the bearing surfaces can be secured, which decreases friction in the bearing and prolongs the lifetime thereof.

In order to further make the lubrication more effective, at least one of the bearing surfaces may be provided with a number of radial grooves.

BRIEF DESCRIPTION OF THE DRAWINGS

In the following, the invention is described more in detail with reference to the attached drawing, in which.

DETAILED DESCRIPTION

Figure 6:
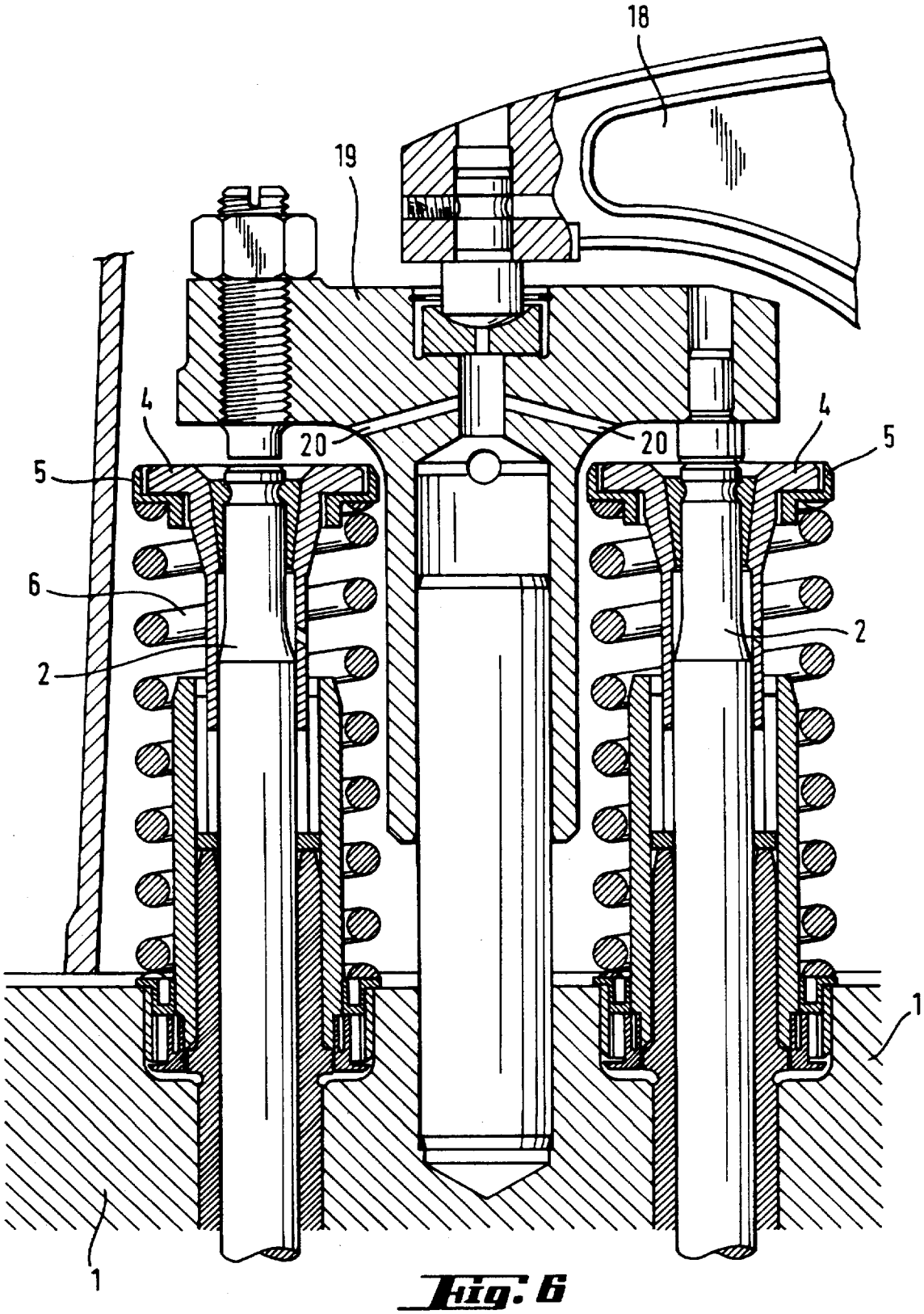
FIG. 6 shows as a sectional view an arrangement comprising two valves with rotation arrangements in accordance with FIG. 1 guided by a valve yoke.

In the drawing 1 indicates a cylinder head, which supports by means of a valve guide 9 a valve with a valve stem 2. The valve is opened under positive guidance in a way known as such for instance through a rocker arm 18 and a valve yoke 19 as shown in FIG. 6, which for their part are guided by a not-shown camshaft. The valve is closed by means of a spring 6 which acts between the cylinder head 1 and a bearing housing element 5 at the upper part of the valve stem 2. The valve stem 2 is fixed to a rotation element 4 by means of two cone-like segment elements 3*a* and 3*b*.

The arrangement comprises also a cylinder element 7, which is by means of a bearing washer 8 fixed thereto rotatably supported with regard to the valve guide 9, and a rotation mechanism 10 which allows rotation in only one direction and blocks rotation in the other direction as will be described below more closely with reference to FIG. 3.

Figure 1:
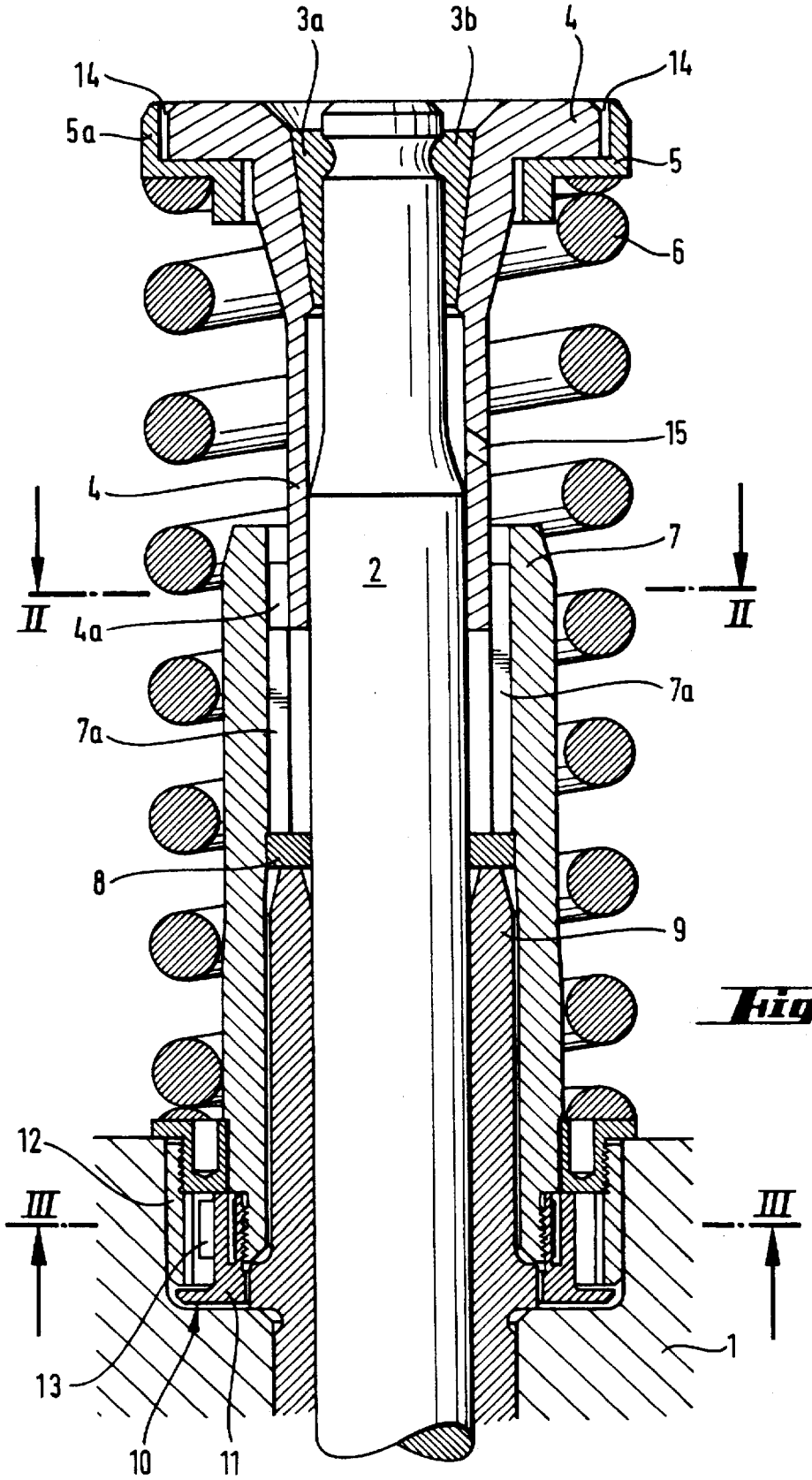
FIG. 1 shows an axial section of a rotation arrangement according to the invention.
Figure 2:
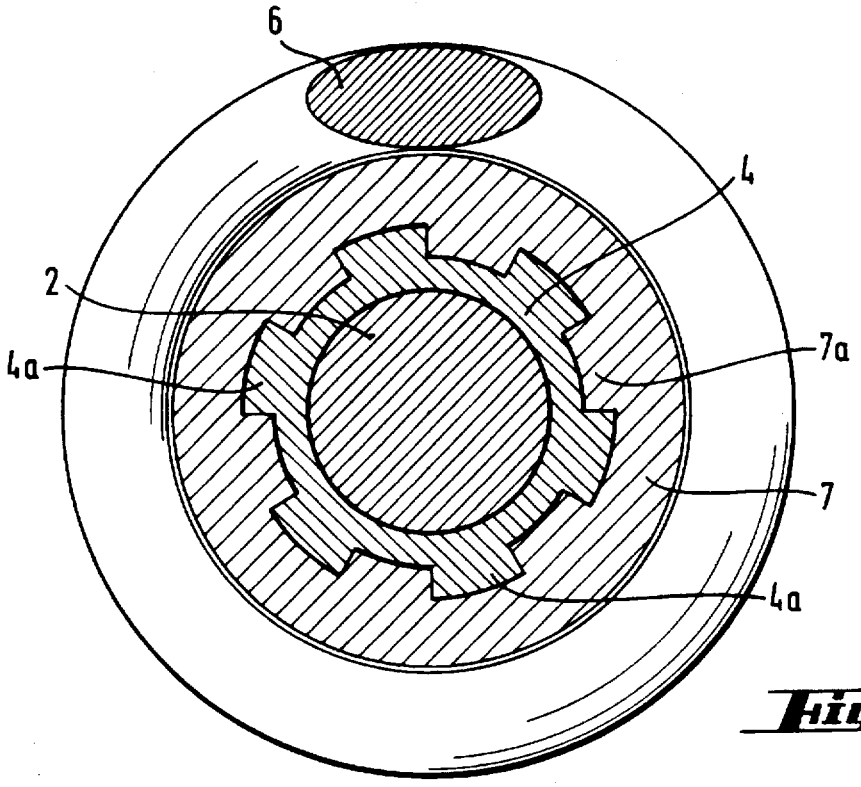
FIG. 2 shows section II—II of FIG. 1.

As is apparent from FIG. 2, the cylinder element 7 comprises a number of bar-like guiding elements 7*a* (splines), which are arranged to guide corresponding guiding elements 4*a* in the rotation element 4. The guiding elements 4*a* and 7*a* do not extend parallel to the valve stem 2. On the contrary, the direction of extension of the guiding elements has a tangential component with respect to the axis of the valve stem, and when the guiding elements are viewed radially with respect to the central axis of the valve stem, they are at an acute angle relative to the axis of the valve stem. Due to the inertia of the valve and friction forces in the tangential direction, it follows that when the valve is opened and the valve stem 2 hereby moves downward in FIG. 1, the guiding elements 7*a* and the corresponding guiding elements 4*a* in the rotation element 4 force the cylinder element 7 to rotate in the direction allowed by the rotation mechanism 10. The slide bearing washer 8 provides then a bearing between the cylinder element 7 and the valve guide 9.

When the valve is to be closed, the rotation of the cylinder element 7 in the opposite direction is blocked by the rotation mechanism 10. As a consequence, the cylinder element 7 forces the rotation element 4 as well as the valve itself to rotate with regard to the bearing housing element 5 and the spring 6. In order to make this possible, there is a slide bearing between the rotation element 4 and the bearing housing element 5, whereby either one or both of these elements may with advantage be of a material serving as bearing metal.

Figure 3:
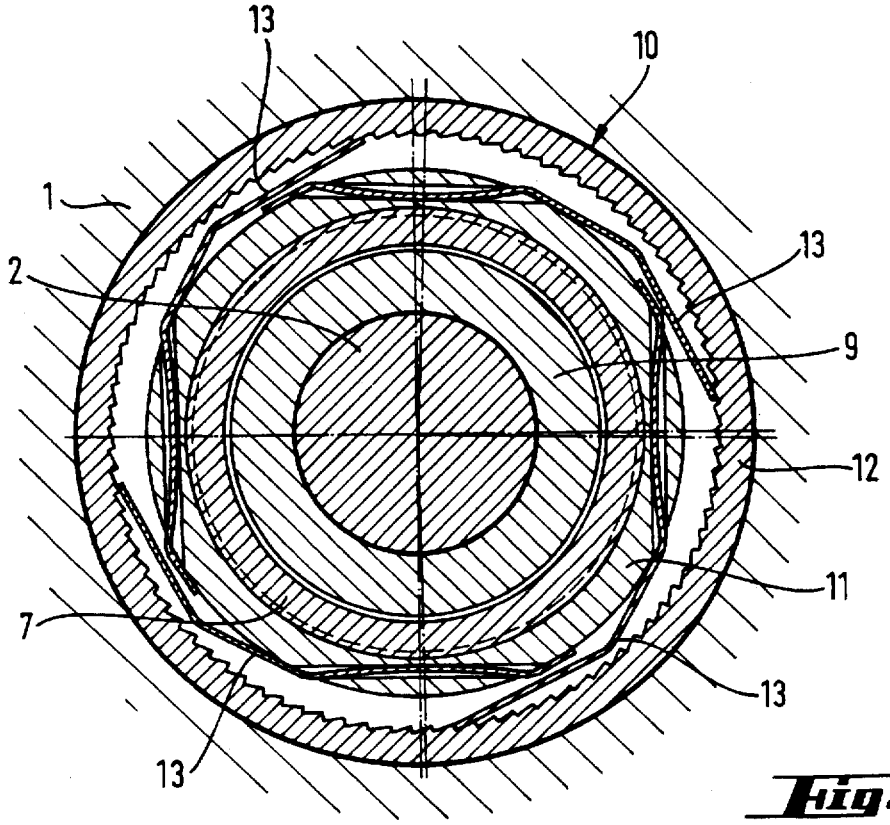
FIG. 3 shows section III—III of FIG. 1 as an enlargement.

The rotation mechanism 10 shown in FIG. 3 comprises a ratchet wheel 12 supported to the cylinder head 1 and a number of spring elements 13, which are installed into a support element 11 fixed to the cylinder element 7 and which are arranged to cooperate with the ratchet wheel 12. Application of the invention is, however, by no means restricted to this mechanism, but many different variations are feasible for forcing rotation in one direction and blocking rotation in the other direction.

Figure 4:
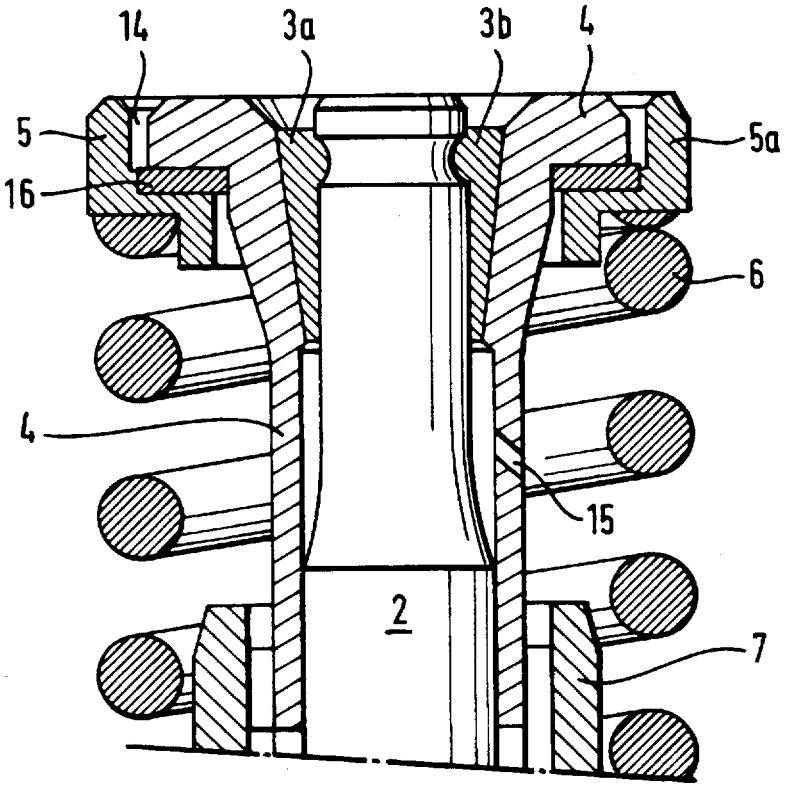
FIG. 4 shows another rotation arrangement according to the invention as a section.
Figure 5:
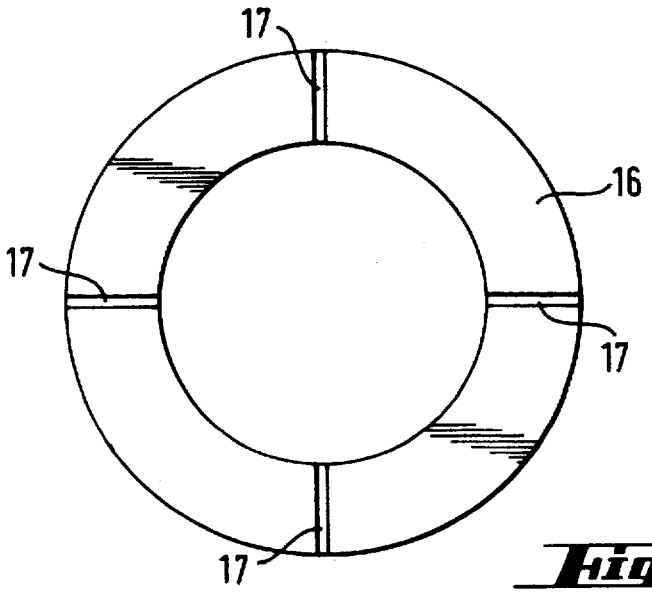
FIG. 5 shows a bearing washer in accordance with FIG. 4 provided with radial grooves for lubrication of the bearing surfaces.

FIG. 4 shows another embodiment of a rotation arrangement according to the invention, whereby a separate bearing washer 16 is arranged between the bearing housing element 5 and the rotation element 4. There may be several bearing washers and they may be provided with a number of radial grooves 17 as shown in FIG. 5 so as to improve lubrication of the bearing surfaces. Naturally the bearing surfaces in the embodiment according to FIG. 1 may also be provided with similar grooves when necessary.

Figure 7:
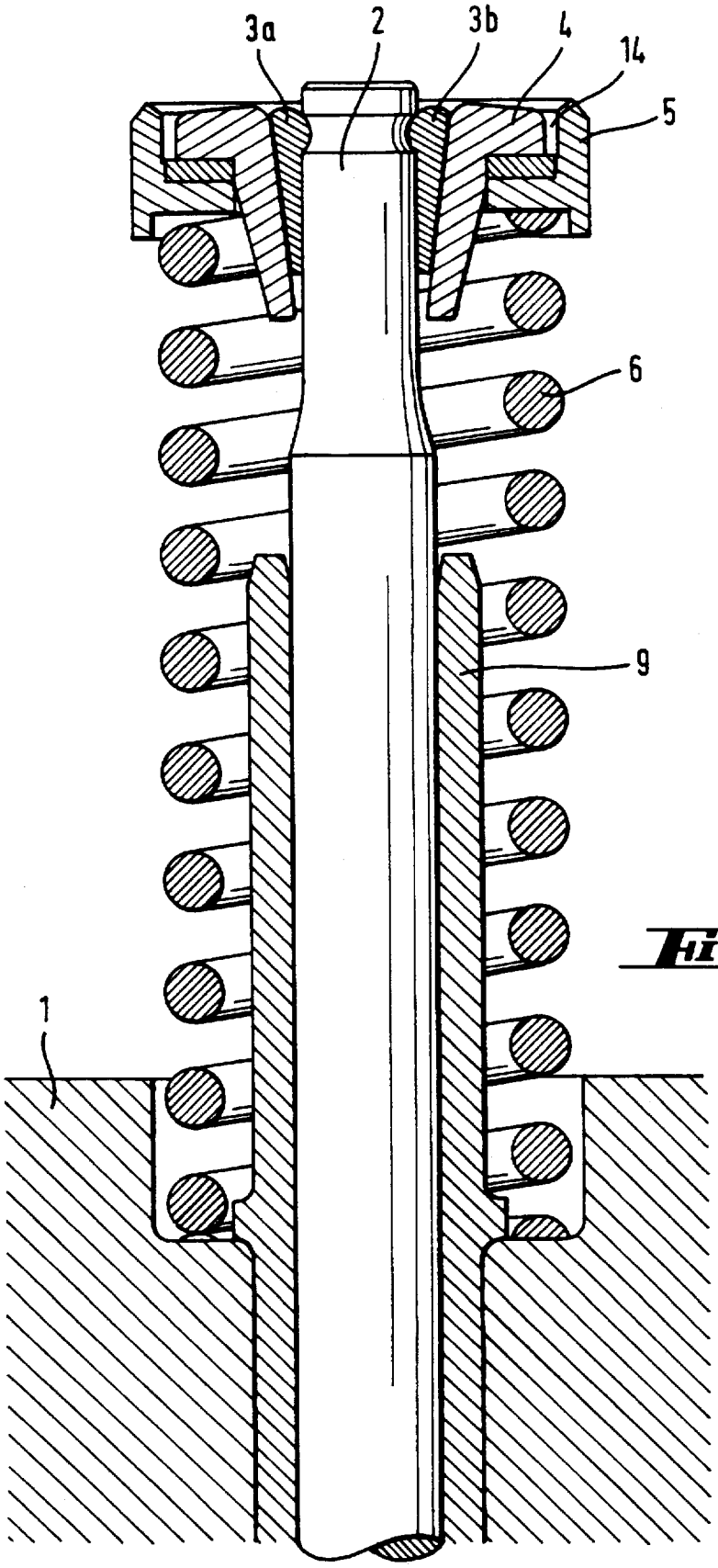
FIG. 7 shows a third rotation arrangement according to the invention as a section.

With reference to FIGS. 1, 6 and 7, the bearing housing element 5 is bowl-formed so that it includes a circular protrusion 5*a* enclosing the rotation element 4 and preferably extending somewhat above the upper surface of the rotation element 4. The protrusion 5*a* and the rotation element 4 are dimensioned so that a circular slot 14 remains therebetween. When the valve yoke 19 is provided with at least one oil duct 20 for each valve, this oil duct 20 can serve for feeding oil to the top of the valve so that an oil pocket is formed between the bearing housing element 5 and the rotation element 4. Because of the static pressure provided by the oil pillar in the oil pocket, the bearing is always well lubricated, which is apt to decrease friction in the bearing and to increase the lifetime thereof.

In this way, the surplus oil drains also down between the segment member halves 3*a* and 3*b* into the space below the segment members between the valve stem 2 and the rotation element 4 to thereafter drain through a number of small holes 15 bored into the rotation element 4 and thereby to lubricate also the guiding elements 7*a* and 4*a*.

In accordance with the third embodiment of the invention shown in FIG. 7, the rotation mechanism 10 comprises the actual valve spring 6, which makes screw-like movement during especially the compression operation thereof with the assistance of the vibrations of the engine. This embodiment is of very uncomplicated construction and serves well for its purpose in spite of the fact that the rotation is not similarly under positive guidance as according to the other embodiments described above.

The invention is not restricted to the embodiments shown, but several modifications are feasible within the scope of the attached claims.

I claim:

1. A valve arrangement in an internal combustion engine including a cylinder head, said valve arrangement comprising:

a valve member having a stem, the valve member being displaceable relative to the cylinder head between a closed position and an open position, a valve actuator for displacing the valve member from its closed position toward its open position under positive guidance, a spring for urging the valve member from its open position toward its closed position, a rotation element attached to an upper part of the valve stem, a bowl-shaped bearing housing element supported on the spring and including an annular rim surrounding the rotation element in spaced relationship therewith, a slide bearing between the rotating element and the bearing housing element for turnably journalling an upper part of the valve stem to the spring, and a rotation mechanism supported at the cylinder head for providing rotation of the valve relative to the cylinder head, and wherein the valve actuator is coupled to the valve stem through a valve yoke which is formed with at least one oil duct for feeding oil to the bearing housing element so that an oil pocket is formed between the bearing housing element and the rotation element.

2. A valve arrangement according to claim 1, wherein the rotation mechanism comprises a positively guided mechanism that forces rotation of the valve in one direction and blocks rotation of the valve in opposite direction, and the rotation element is in force transmitting relationship with the rotation mechanism.

3. A valve arrangement according to claim 1, wherein the rotation mechanism comprises a cylinder element that coaxially surrounds the valve stem, a clutch device effective between the cylinder head and the cylinder element and allowing the cylinder element to rotate in one direction relative to the cylinder head and blocking rotation of the cylinder element relative to the cylinder head in opposite direction, and first and second guiding elements fast with the rotation element and the cylinder element respectively, the first and second guiding elements extending longitudinally of the valve stem and having a tangential component of extension relative to the valve stem.

4. A valve arrangement according to claim 1, wherein the slide bearing is constituted by the rotation element and the bearing housing element being in direct sliding contact.

5. A valve arrangement according to claim 1, wherein the slide bearing is constituted by the rotation element and the bearing housing element each being in direct sliding contact with a bearing washer disposed between the rotation element and the bearing housing element.

6. A valve arrangement according to claim 1, wherein at least one of said elements is made of a material serving as bearing metal.

7. A valve arrangement according to claim 1, comprising at least one bearing washer between the rotation element and the bearing housing element.

8. A valve arrangement according to claim 1, wherein the annular rim extends above the rotation element.

9. A valve arrangement according to claim 1, wherein at least one of said elements has a bearing surface that is formed with radial grooves for lubricant.

10. A valve arrangement in an internal combustion engine including a cylinder head, said valve arrangement comprising:

a valve member having a stem, the valve member being displaceable relative to the cylinder head lengthwise of the stem between a closed position and an open position, a valve actuator for displacing the valve member from its closed position toward its open position under positive guidance, a spring supported at the cylinder head for urging the valve member from its open position toward its closed position, a rotation element attached to an upper part of the valve stem, a bowl-shaped bearing housing element supported on the spring and including an annular rim surrounding the rotation element in spaced relationship therewith, and a slide bearing between the rotating element and the bearing housing for turnably journalling an upper part of the valve stem to the spring, and wherein the spring functions as a rotation mechanism supported at the cylinder head for providing rotation of the valve relative to the cylinder head, and the valve actuator is coupled to the valve stem through a valve yoke which is formed with at least one oil duct for feeding oil to the bearing housing element so that an oil pocket is formed between the bearing housing element and the rotation element.

11. A valve arrangement according to claim 10, wherein the slide bearing is constituted by the rotation element and the bearing housing element each being in direct sliding contact with a bearing washer disposed between the rotation element and the bearing housing element.

12. A valve arrangement according to claim 10, wherein at least one of said elements is made of a material serving as bearing metal.

13. A valve arrangement according to claim 10, comprising at least one bearing washer between the rotation element and the bearing housing element.

14. A valve arrangement according to claim 10, wherein the annular rim extends above the rotation element.

15. A valve arrangement according to claim 10, wherein at least one of said elements has a bearing surface that is formed with radial grooves for lubricant.

16. A valve arrangement in an internal combustion engine including a cylinder head, said valve arrangement comprising:

a valve member having a stem, the valve member being displaceable relative to the cylinder head between a closed position and an open position, a rotation element attached to an upper part of the valve stem, a bearing housing element accommodating the rotation element in a manner allowing the rotation element to turn relative to the bearing housing element in sliding relationship therewith, the bearing housing element being bowl-shaped and including an annular rim surrounding the rotation element in spaced relationship therewith, a valve actuator for displacing the valve member from its closed position toward its open position under positive guidance, a spring effective between the cylinder head and the bearing housing element for urging the valve member from its open position toward its closed position, and a rotation mechanism supported at the cylinder head for providing rotation of the valve relative to the cylinder head, and wherein the valve actuator is coupled to the valve stem through a valve yoke which is formed with at least one oil duct for feeding oil to the bearing housing element so that an oil pocket is formed between the bearing housing element and the rotation element.

17. A valve arrangement according to claim 16, wherein the slide bearing is constituted by the rotation element and the bearing housing element being in direct sliding contact.

18. A valve arrangement according to claim 16, wherein the annular rim extends above the rotation element.

19. A valve arrangement in an internal combustion engine including a cylinder head, said valve arrangement comprising:

a valve member having a stem, the valve member being displaceable relative to the cylinder head lengthwise of the stem between a closed position and an open position, a rotation element attached to an upper part of the valve stem, a bearing housing element accommodating the rotation element in a manner allowing the rotation element to turn relative to the bearing housing element in sliding relationship therewith, the bearing housing element being bowl-shaped and including an annular rim surrounding the rotation element in spaced relationship therewith, a valve actuator for displacing the valve member from its closed position toward its open position under positive guidance, and a spring supported at the cylinder head for urging the valve member from its open position toward its closed position, and wherein the spring functions as a rotation mechanism supported at the cylinder head for providing rotation of the valve relative to the cylinder head, and the valve actuator is coupled to the valve stem through a valve yoke which is formed with at least one oil duct for feeding oil to the bearing housing element so that an oil pocket is formed between the bearing housing element and the rotation element.

20. A valve arrangement according to claim 19, wherein the slide bearing is constituted by the rotation element and the bearing housing element being in direct sliding contact.

21. A valve arrangement according to claim 19, wherein the annular rim extends above the rotation element.

* * * * *